US006436013B1

(12) United States Patent
Krull

(10) Patent No.: US 6,436,013 B1
(45) Date of Patent: Aug. 20, 2002

(54) METHOD AND APPARATUS FOR ADJUSTINGS RESISTANCE TO EXERCISE

(76) Inventor: Mark A. Krull, P.O. Box 57, Greencastle, IN (US) 46135

( * ) Notice: Subject to any disclaimer, the term of this patent is extended or adjusted under 35 U.S.C. 154(b) by 0 days.

(21) Appl. No.: 09/695,668

(22) Filed: Oct. 24, 2000

Related U.S. Application Data

(60) Provisional application No. 60/162,291, filed on Oct. 28, 1999.

(51) Int. Cl.[7] ..... A63B 21/00
(52) U.S. Cl. ..... 482/94; 982/98; 982/99
(58) Field of Search ..... 482/98–103, 138

(56) References Cited

U.S. PATENT DOCUMENTS

| | | | | | |
|---|---|---|---|---|---|
| 4,627,615 | A | | 12/1986 | Nurkowski | 482/98 |
| 4,730,828 | A | * | 3/1988 | Lane | 482/98 |
| 4,765,611 | A | | 8/1988 | MacMillan | 482/98 |
| 4,809,973 | A | | 3/1989 | Johns | 482/98 |
| 4,834,365 | A | | 5/1989 | Jones | 482/99 |
| 5,643,152 | A | | 7/1997 | Simonson | 482/98 |
| 5,776,040 | A | | 7/1998 | Webb et al. | 482/98 |
| 5,935,048 | A | * | 8/1999 | Krull | 482/98 |

FOREIGN PATENT DOCUMENTS

| | | | |
|---|---|---|---|
| FR | 2613237 | 10/1980 | 482/99 |
| JP | 10-118222 | 5/1998 | 482/98 |
| SU | 1347948 | 10/1987 | 482/98 |
| SU | 1443898 | 12/1988 | 482/98 |

OTHER PUBLICATIONS

Cybex Strength Systems (Brochure) ©1994 (6 pages).

* cited by examiner

*Primary Examiner*—John Mulcahy

(57) ABSTRACT

A weight stack exercise machine includes a stack of primary weights movably mounted on a frame, and at least one counter-weight which is selectively movable between an inactive position, supported by the frame, and an active position, acting on the top plate in the stack of primary weights.

33 Claims, 3 Drawing Sheets

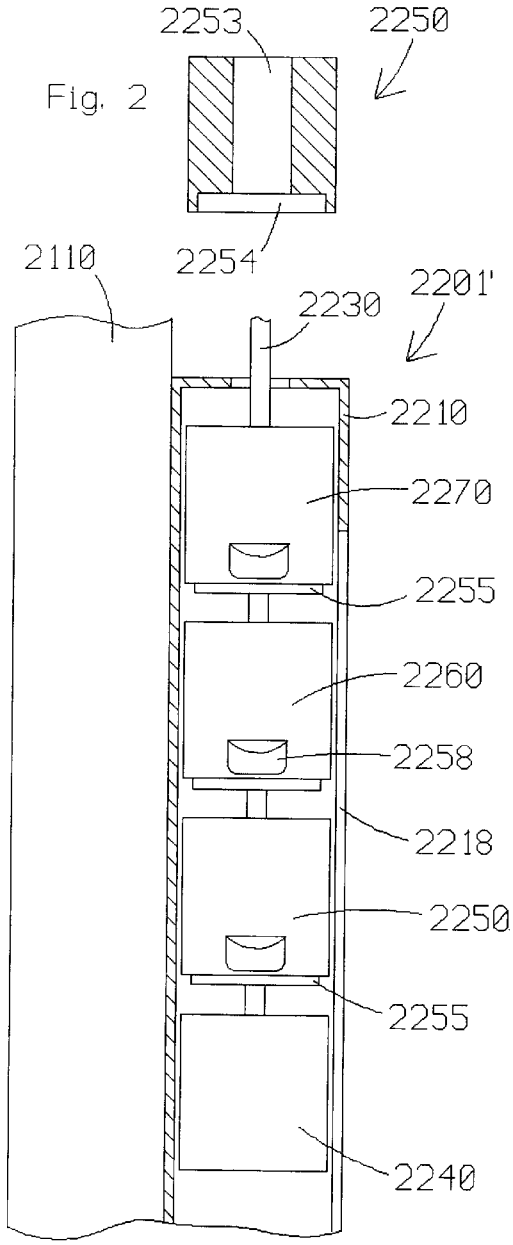
Fig. 2
Fig. 3
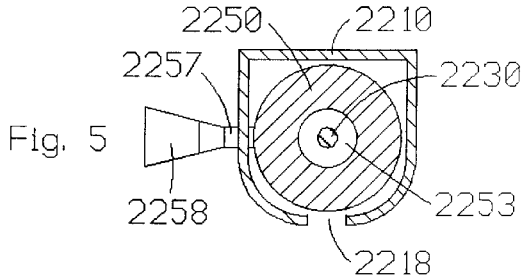
Fig. 5
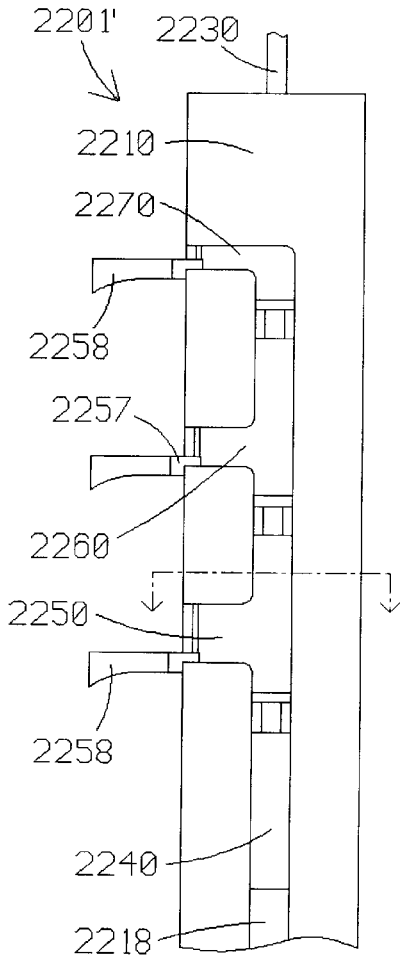
Fig. 4

METHOD AND APPARATUS FOR ADJUSTINGS RESISTANCE TO EXERCISE

CROSS-REFERENCE TO RELATED APPLICATIONS

This application discloses subject matter entitled to the filing date of U.S. Provisional Application No. 60/162,291, filed on Oct. 28, 1999.

FIELD OF THE INVENTION

The present invention relates to exercise equipment and more particularly, to exercise equipment that uses a variable number of weights to resist exercise motion.

BACKGROUND OF THE INVENTION

Exercise weight stacks are known in the art. Generally speaking, weight plates are arranged in a stack and movably mounted on at least one guide rod or rail. A selector rod is connected to a desired number of weight plates by a pin (or other suitable means known in the art). The selector rod and any selected weight plates are connected to a force receiving member by a cable (or other suitable means known in the art) which pulls the weight plates upward in response to exercise movement.

Although exercise weight stacks are prevalent in the exercise industry, they nonetheless suffer from certain shortcomings. For example, in order to provide a large amount of weight at a reasonable cost and within a reasonable amount of space, equipment manufacturers use a small number of relatively heavy weight plates. As a result, the amount of weight being lifted cannot be adjusted in small increments. On the other hand, a relatively large number of lighter weight plates may be used in order to provide smaller increments in weight adjustment, but the resulting equipment would be relatively more expensive and/or bulky.

Attempts have been made to address the issue of incremental weight adjustments. One such approach involves the provision of a loose half-weight (weighing one-half as much as a weight plate in the stack) that is selectively movable onto the top plate at the discretion of a user. This particular arrangement is not well suited for institutional environments because the half-weight may be lost or misused. Another prior art approach involves the provision of a half-weight or other fractional weight(s) that is/are selectively movable from a peg on the frame onto an aligned peg on the top plate of the stack. This approach not only fails to overcome the possibility of losing the half-weight, but it creates a balance problem during movement of the selected weights, and it also increases the potential for injury due to the proximity of the two pegs and their movement relative to one another. Yet another prior art approach involves the provision of a second, smaller weight stack comprising weight plates which weigh a fraction of the weight plates in the primary stack. Unfortunately, this approach adds significantly to both the cost and the size of the equipment.

Yet another prior art weight stack machine with supplemental or secondary weights is disclosed in French Patent No. 2, 613,237 to Louvet. The Louvet machine includes a stack of primary weight plates movable along a guide rod in response to exercise movement, and a stack of secondary weights movable along the guide rod and selectively stored above the stack of primary weight plates. The secondary weights are supported by gates which are rotatably mounted on rigid frame members, and which have pegs that rotate into engagement with holes in the frame members. Each of the nine secondary weights has a mass equal to one-tenth the mass of one of the primary weight plates. One disadvantage of the Louvet machine is that nothing prevents a user from releasing a secondary weight without grasping the weight. As a result, the secondary weight may be free to drop downward onto the top plate in the primary weight stack, thereby increasing the likelihood of personal injury and/or damage to the machine. Also, each of the secondary weights is not separately supported by a respective gate. As a result, the entire stack of secondary weights may be released at one time, with or without a user holding onto any of the weights.

Still other prior art approaches are disclosed in Soviet Union Patent No. 1347-948-A and Japan Patent No. 10-118222. Each of these patents discloses first and second secondary weights which are movably mounted on discrete guide rods outside the planform of the primary weight stack. The secondary weights in the Soviet patent are pivotally mounted on respective, dedicated guide rods for movement into respective positions overlying the top plate in the primary weight stack. The secondary weights in the Japan patent are releasably secured to the top plate by a separate selector pin. A shortcoming common to both of these approaches is the need for separate guide rods for the secondary weights, and/or the imposition of non-aligned weight on the primary weight stack. In other words, despite all of the efforts discussed above, room for better solutions and/or improvements remains.

SUMMARY OF THE INVENTION

Generally speaking, the present invention relates to exercise methods and apparatus involving a stack of primary weight plates movably mounted relative to a frame, and at least one secondary weight which is selectively activated to incrementally reduce the weight of the selected primary weight plates. A connector is selectively interconnected between the secondary weight and the top plate in the primary weight stack. More specifically, the connector includes a first portion which is connected to the top plate, a second portion which selectively supports the secondary weight, and a third portion which is intermediate the first portion and the second portion, and which is connected to the machine frame. As a result of this arrangement, the secondary weight acts as a counter-weight vis-a-vis the top plate when the former is supported by the second portion of the connector. On a preferred embodiment, the secondary weight is selectively rotatable between an active position, supported by the connector, and an inactive position, supported by the frame. Also, the connector is preferably a cable, and the third, intermediate portion of the connector is preferably routed about pulleys on the frame. Moreover, the frame is preferably provided with structure to guide the secondary weight in a direction opposite that of the top plate..

The secondary weight(s) may be configured to engage and disengage the frame in various ways, including rotational movement, translational movement, or a combination thereof. Also, the present invention may be implemented on new equipment or tailored for retrofit on existing equipment, and/or the present invention may be implemented so that the secondary weight(s) act upon the top plate throughout an exercise motion or any desired portion thereof. Many of the features, variations, and advantages of the present invention will become apparent from the more detailed description that follows.

BRIEF DESCRIPTION OF THE FIGURES OF THE DRAWING

FIG. 2 is a sectioned side view of a secondary weight on the exercise apparatus of FIG. 1;

FIG. 3 is a partially sectioned and fragmented, front view of a secondary weight assembly on the exercise apparatus of FIG. 1, with optional knobs shown on the secondary weights;

FIG. 4 is a partially fragmented, side view of the secondary weight assembly of FIG. 3;

FIG. 5 is a partially sectioned top view of the secondary weight assembly of FIG. 3;

DETAILED DESCRIPTION OF A PREFERRED EMBODIMENT

The present invention provides methods and apparatus related to incremental adjustment of weight stack resistance. More specifically, an otherwise conventional weight stack machine is provided with at least one counter-weight that is selectively maneuverable between an inactive position, supported by the frame, and an active position, acting upon the top plate in the primary weight stack.

Figure 1:
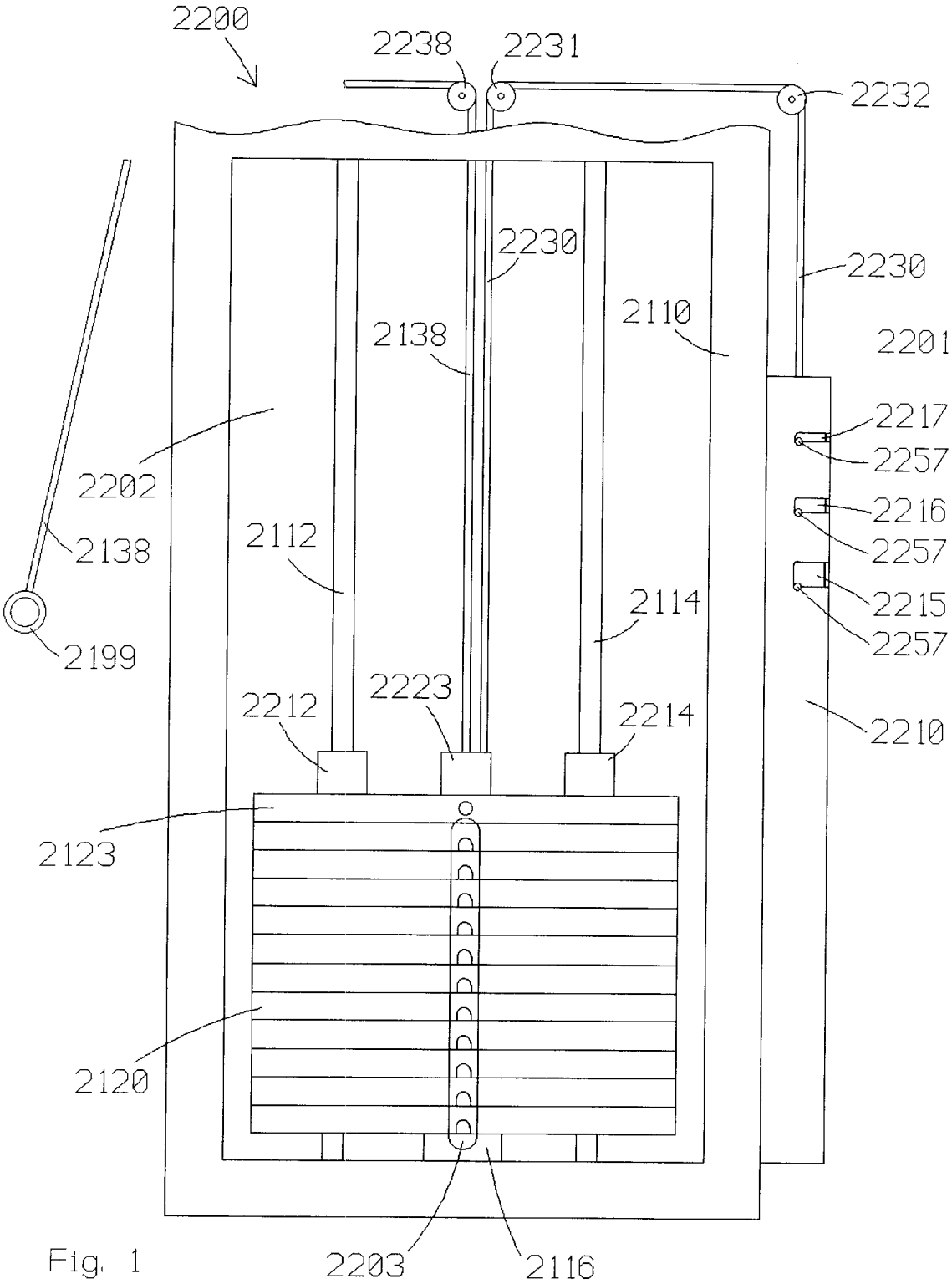
FIG. 1 is a partially fragmented, front view of another exercise apparatus constructed according to the principles of the present invention.

With reference to the Figures of the Drawing, wherein like numerals represent like parts and assemblies throughout the several views, FIG. 1 shows a preferred embodiment weight stack machine 2200 which has been assembled in accordance with the principles of the present invention. The machine 2200 includes a top plate 2123 and additional, underlying weight plates 2120 which are arranged in a vertical stack and movably mounted on a frame 2110 by guide rods 2112 and 2114 (or other suitable means known in the art). Bushings 2212 and 2214 may be rigidly mounted on the top plate 2123 to encourage proper alignment of the top plate 2123 and the underlying weight plates 2120 relative to the guide rods 2112 and 2114. A resilient bumper 2116 is preferably mounted on a lower portion of the frame 2110 to support any weight plates not in use and/or to absorb impact when the lifted weight plates are returned to a rest position. A selector rod 2130 extends through the weight stack and is connected to at least one force receiving member 2199 by a cable 2138 (or other suitable means known in the art). An intermediate portion of the cable 2138 is routed about at least one pulley 2238 on the frame 2110.

A transparent shield 2202 is mounted on the frame 2110 and spans the front of the machine 2200, effectively separating a user of the machine 2200 from the guide rods 2112 and 2114 and the weight stack. A central slot 2203 is provided in the shield 2202 to facilitate insertion of a conventional selector pin into engagement with any desired weight plate 2120 in the stack. This embodiment 2200 requires a selector pin which inserts entirely inside the shield 2202, since the slot 2203 is limited to the height of the weight stack. However, those skilled in the art will recognize that other primary weight stack selection methods may be employed without departing from the scope of the present invention.

A central block 2223 is rigidly mounted on the top plate 2123 and axially aligned with the cable 2138. Both the weight stack cable 2138 and a second cable 2230 are connected to the block 2223 and/or the underlying top plate 2123. The second cable 2230 is routed about pulleys 2231 and 2232 to a supplemental or secondary weight assembly 2201. A remote end of the cable 2230 is connected to a counterweight 2240 which preferably has a mass equal to that of the central block 2223 on the top plate 2123. As a result of this arrangement, the counterweight 2240 offsets the weight of the central block 2223 and maintains the cable 2230 taut as the top plate 2123 moves up and down relative to the frame 2110.

The secondary weight assembly 2201 includes an elongate housing or tube 2210 which has a longitudinal axis and is rigidly mounted to a side of the frame 2110 by bolts or other suitable fasteners. One side of the housing 2210 is bounded by square corners and bears against the frame 2110. An opposite side of the housing 2210 is rounded and faces away from the frame 2110. A vertical slot 2218 extends vertically along the rounded side of the housing 2210, to accommodate vertical travel of the weights 2250, 2260, and 2270 relative to the housing 2210; and discrete horizontal slots 2215, 2216, and 2217 extend from the vertical slot 2218 toward the front of the machine 2200, to accommodate rotation of respective weights 2250, 2260, and 2270 relative to the housing 2210; and each horizontal slot 2215, 2216, and 2217 terminates with a downwardly extending notch (designated as 2219 in FIG. 7), to bias a respective weight 2250, 2260, or 2270 to remain in place relative to the housing 2210.

As shown in FIG. 5, the cross-section of the housing 2210 is configured to accommodate the counterweight 2240 and the similarly sized secondary weights 2250, 2260, and 2270. The housing 2210 is preferable made of plastic, and the weights disposed inside the housing 2210 are preferably made of stainless steel, so that the latter are slideable relative to the former with relatively little frictional resistance. Other weight guiding arrangements, including strips of low friction material or guide rods, for example, may be used without departing from the scope of the present invention. Each of the weights 2250, 2260, and 2270 is preferably configured to weigh one-quarter as much as one of the weight plates 2120 in the stack. However, other quantities of mass and/or numbers of weights may be provided in the alternative.

FIG. 2 shows a cross-section of the lowest secondary weight 2250, which is representative of the other secondary weights 2260 and 2270 (and may also be representative of the counterweight 2240, depending upon manufacturing preferences). The weight 2250 may be described as a cylindrical shell having an outside diameter sized for linear movement within the housing 2210. A central bore 2253 extends through the weight 2250 and defines an inside diameter sized to accommodate unhindered passage of the cable 2230. A relatively larger diameter recess 2254 extends into the bottom of the weight 2250 to receive a rubber disk 2255, which defines an inside diameter at least as large as that of the bore 2253. If economies of scale dictate that the counterweight 2240 be configured similar to the secondary weight 2250, then an anchor piece may be configured to fasten to the end of the cable 2230 and to occupy the recess 2254 and bore 2253 on the counterweight 2240.

A shaft 2257 extends radially outward from each of the secondary weights 2250, 2260, and 2270. As suggested by FIGS. 3–5, handles 2258 (or other suitable members) may be mounted on the shafts 2257 to facilitate maneuvering of the weights 2250, 2260, and 2270 relative to the housing 2210. Each shaft 2257 is sized and configured to rest within a respective notch 2219, move along a respective horizontal slot 2215, 2216, or 2217, and move along the common vertical slot 2218. FIGS. 3–4 show each of the secondary weights 2250, 2260, and 2270 with its shaft 2257 occupying a respective notch 2219. Under these conditions, the secondary weights 2250, 2260, and 2270 are supported by the housing 2210 (in stationary positions), and the secondary weight assembly 2201 has no effect on the "primary" weight selected by a user of the machine 2200 (recognizing that the counterweight 2240 and the block 2223 simply counterbalance one another).

Figure 6:
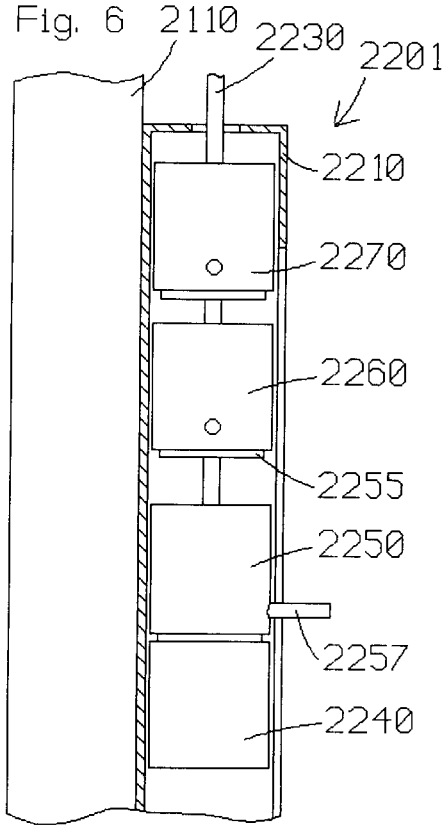
FIG. 6 is a partially sectioned fragmented, front view of the secondary weight assembly of FIG. 3, with one of the secondary weights rotated out of engagement with the secondary weight holder (and without the optional knobs)
Figure 7:
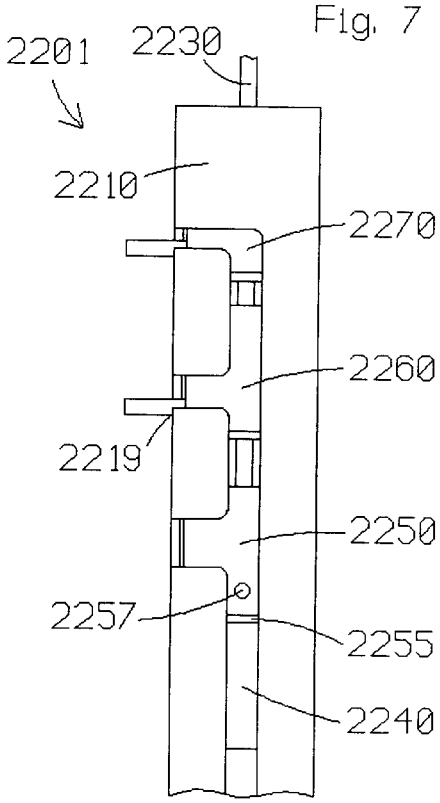
FIG. 7 is a partially fragmented, side view of the secondary weight assembly of FIG. 6.

FIGS. 6–7 show the lowest secondary weight 2250 with its shaft 2257 rotated out of its horizontal slot 2215 and into the vertical slot 2218. As a result, the lowest secondary weight 2250 is free of the housing 2210 and supported instead by the counterweight 2240. In this activated state, the secondary weight assembly 2201 reduces the exercise load of the primary weight stack by one-quarter of the weight of a plate 2120 in the primary weight stack. For example, if each of the weight plates 2120 weighs ten pounds, and one hundred pounds is currently secured to the selector rod, then the "activation" of the lowest secondary weight 2250 reduces the selected weight to ninety-seven and one-half pounds.

Figure 8:
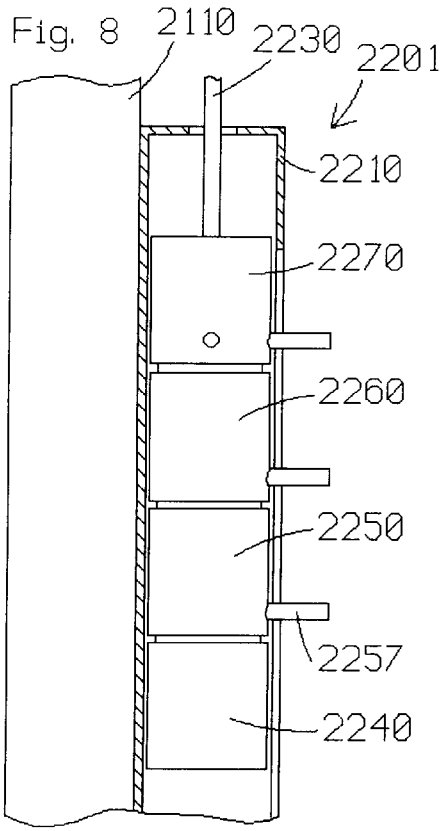
FIG. 8 is a partially sectioned fragmented, front view of the secondary weight assembly of FIG. 6, with all of the secondary weights rotated out of engagement with the secondary weight holder.
Figure 9:
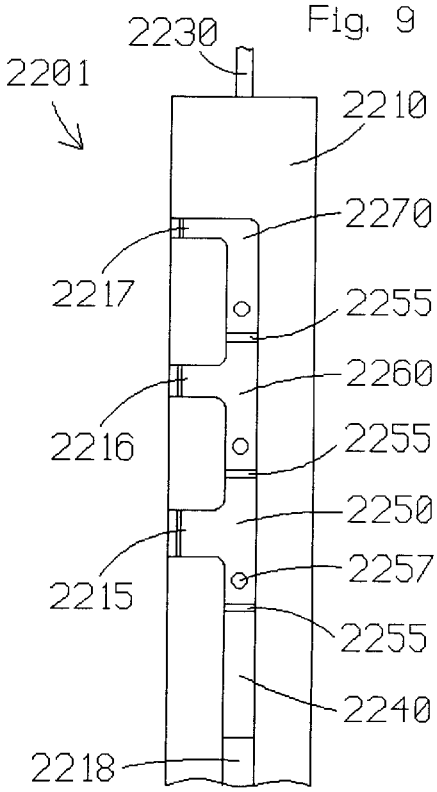
FIG. 9 is a partially fragmented, side view of the secondary weight assembly of FIG. 8.

FIGS. 8–9 show all three secondary weights 2250, 2260, and 2270 with their shafts 2257 rotated out of their respective horizontal slots 2215, 2216, and 2217, and into the vertical slot 2218. As a result of this change, all three secondary weights 2250, 2260, and 2270 are free of the housing 2210 and supported by the counterweight 2240. In this activated state, the secondary weight assembly 2201 reduces the exercise load of the primary weight stack by three-quarters of the weight of a plate 2120 (or seven and one-half pounds in the example set forth in the foregoing paragraph).

The slots 2215, 2216, and 2217 are configured in such a manner that all three secondary weights 2250, 2260, and 2270 may be rotated together relative to the housing 2210. In this regard, the middle horizontal slot 2216 is sufficiently tall to accommodate travel of the middle weight 2260 upward into contact with the highest weight 2270 while the weights 2260 and 2270 are in their stationary orientation. Similarly, the lowest horizontal slot 2215 is sufficiently tall to accommodate travel of the lowest weight 2250 upward into contact with the middle weight 2260 while the weights 2250 and 2260 are in their storage orientation (regardless of the vertical position of the middle weight 2260 relative to the highest weight 2270). In other words, a user may lift up the lowest weight 2250 until both of the weights 2260 and 2270 are supported on the lowest weight 2250, and then the weights 2260 and 2270 will rotate together with the weight 2250 into activation (with the shafts 2257 within the vertical slot 2218).

In addition to reducing noise and/or absorbing impact, the rubber disks 2255 provide a high friction interface between adjacent weights to discourage relative rotation therebetween. Those skilled in the art will recognize that registration pegs or other suitable means may be provided in the alternative or in addition to the disks 2255, to maintain the activated secondary weights in alignment with both the counterweight 2240 and one another.

Those skilled in the art will also recognize that the secondary weight assembly 2201 may be operated in an additive mode, as opposed to a deductive mode, from the perspective of a person using the machine 2200. For example, from the user's perspective, the secondary weights 2250, 2260, and 2270 could be considered "zeroed" when activated and movable along the vertical slot 2218, and "additive" when deactivated and supported by the housing 2210. In this alternative arrangement, the top plate 2123 is preferably configured to provide ten pounds of resistance when all four of the weights 2240, 2250, 2260, and 2270 are supported on the cable 2230. When the shaft 2257 on the highest weight 2270 is rotated into the horizontal slot 2217 (a stationary position), the result is a two and one-half pound increase in the user-applied force required to lift the top plate 2123.

The present invention may be considered advantageous to the extent that it facilitates storage and/or handling of the weights outside the path of the primary weight stack, allows any desired shrouding of the machine components, and/or does not negatively impact the balance of the top plate. Those skilled in the art will also recognize that the present invention may be implemented with a flexible connector, such as cable 2230, or with other connector arrangements, including a pivoting lever, for example. Furthermore, the subject invention is not limited to the operational specifics of the depicted weight selection assembly 2201. In fact, various other weight selection methods, including ones disclosed in U.S. Pat. No. 5,944,642 and the patents identified above in the Background of the Invention (all of which are incorporated herein by reference), may be used to selectively engage and disengage counterweight(s) vis-a-vis the connector 2230. Among other things, the counterweight(s) could be moved laterally and/or pinned to the connector and/or an associated selector member.

The foregoing description not only references a specific embodiment and a particular method, but it will also lead those skilled in the art to recognize additional embodiments, methods, improvements, combinations, and/or applications. In view of the foregoing, the scope of the present invention is to be limited only to the extent of the following claims.

What is claimed is:

1. An exercise apparatus, comprising:

a frame that includes a tubular guide;

a stack of weights movably mounted on the frame apart from the tubular guide, wherein the stack includes a top plate which is movable along a path;

a connector having a first portion, a second portion, and a third portion, wherein the first portion is connected to the top plate, and the third portion is intermediate the first portion and the second portion and is connected to the frame; and a separate weight disposed inside the guide and selectively movable between an inactive position, supported by the frame, and an active position, supported by the second portion of the connector.

2. The exercise apparatus of claim 1, further comprising a second said separate weight.

3. The exercise apparatus of claim 2, wherein the second said separate weight is disposed over the first separate weight.

4. The exercise apparatus of claim 3, wherein the frame holds the second said separate weight at a distance above the first separate weight when each said separate weight occupies a respective inactive position.

5. The exercise apparatus of claim 2, wherein the separate weight and the second said separate weight include means for discouraging rotation therebetween when each said separate weight occupies its respective active position.

6. The exercise apparatus of claim 1, wherein the connector is a flexible cable.

7. The exercise apparatus of claim 6, wherein the intermediate portion of the cable is routed about at least one pulley on the frame.

8. The exercise apparatus of claim 6, wherein the cable extends through the separate weight.

9. The exercise apparatus of claim 1, wherein the separate weight is movably mounted on the frame for movement into and out of engagement with the second portion of the connector.

10. The exercise apparatus of claim 9, wherein the separate weight and the top plate are constrained to move in opposite directions whenever the separate weight occupies its active position.

11. The exercise apparatus of claim 9, wherein the separate weight rotates relative to both the frame and the connector to move between the inactive position and the active position.

12. A method of adjusting resistance to exercise, comprising the steps of:

providing a frame;

providing a stack of weights which includes a top plate;

movably mounting the stack on the frame in such a manner that the top plate is movable along a top plate path having an upper extreme and a lower extreme;

providing a counter-weight;

movably mounting the counter-weight on the frame in such a manner that the counter-weight is movable along a separate, counter-weight path having an upper limit and a lower limit;

providing a flexible connector; and connecting the flexible connector between the top plate and the counter-weight in a manner that constrains the top plate and the counter-weight to move in opposite directions, and the connector prevents the counter-weight from reaching its lower limit.

13. The method of claim 12, wherein the connecting step involves connecting a first end of the flexible connector directly to the top plate, connecting a second end of the flexible connector directly to the counter-weight, and routing a third, intermediate portion of the flexible connector about at least one guide on the frame.

14. The method of claim 12, further comprising the step of moving a second counter-weight from an inactive position, supported by the frame, to an active position, supported by the connector.

15. The method of claim 14, wherein the moving step involving the second counter-weight is performed when the first said counter-weight is disposed at the upper limit of the counter-weight path.

16. The method of claim 12, further comprising the step of movably mounting the counter-weight inside a guide on the frame for movement along a prescribed path when connected to the top plate.

17. The method of claim 12, wherein the connecting step constrains the counter-weight to occupy the upper limit of the counter-weight path when the top plate occupies the lower extreme of the top plate path.

18. A method of adjusting resistance to exercise, comprising the steps of:

providing a frame;

providing a first weight;

movably mounting the first weight on the frame for movement between a lower position and an upper position;

providing a force receiving member;

connecting the force receiving member to the first weight in such a manner that the first weight moves upward in response to sufficient force applied against the force receiving member;

providing a counter-weight support;

movably mounting the counter-weight support on the frame for movement between an upper position and a lower position;

connecting the first weight to the counter-weight support in such a manner that the counter-weight support is constrained to move downward as the first weight moves upward, and the counterweight support is constrained to move upward as the first weight moves downward;

providing a second weight; and selectively loading the second weight onto the counter-weight support while the counter-weight support occupies its upper position, thereby reducing how much force is required to move the first weight upward.

19. The method of claim 18, wherein the second connecting step involves providing a cable; connecting a first end portion of the cable to the first weight; connecting an opposite, second end portion of the cable to the counter-weight support; and routing an intermediate portion of the cable upward and about at least one guide on the frame.

20. The method of claim 19, wherein the second weight is supported in an inactive position on the frame prior to the loading step, and the cable passes through an opening in the second weight when the second weight occupies the inactive position.

21. The method of claim 19, wherein the second end portion of the cable is maintained in axial alignment with a center of mass defined by the second weight.

22. The method of claim 19, wherein opposite ends of the cable are connected directly to the first weight and the counter-weight support, respectively, so that when the second weight is loaded onto the counter-weight support, the second weight is constrained to remain a fixed distance from the first weight, as measured along the cable.

23. The method of claim 18, wherein the first weight is constrained to move along a first path, and the second weight is constrained to move along a second path, and the frame is provided with a frame member disposed between the first path and the second path.

24. The method of claim 18, wherein the second weight has a perimeter, and the frame is provided with a vertically oriented guide disposed about the perimeter of the second weight to define its path of motion.

25. The method of claim 18, wherein the first weight is connected to the counter-weight support in a manner that maintains the counter-weight support in a suspended state at all times.

26. The method of claim 18, wherein the frame is provided with a shield that defines a shielded apace, and the first weight is constrained to move along a path disposed inside the shielded space, and the second weight is constrained to move along a path disposed outside the shielded space.

27. The method of claim 18, wherein the first weight is movably mounted on the frame for movement along a path having a lower end that defines a rest position for the top plate, and the counter-weight support is movably mounted on the frame for movement along a path having an upper end that defines a rest position for the counter-weight support, and a flexible cable is directly interconnected between the first weight and the counter-weight support in a manner that constrains the counter-weight support to move downward from its rest position as the first weight moves upward from its rest position, and constrains the counter-weight support to return upward to its rest position as the first weight returns downward to its rest position.

28. An exercise weight stack assembly, comprising:

a frame;

a stack of weights, including a top plate, movably mounted on the frame;

a counter-weight support;

a flexible connector having an intermediate portion routed about an upwardly disposed portion of the frame, and opposite ends connected directly to the top plate and the counter-weight support, respectively, thereby constraining the top plate and the counter-weight support to move in opposite directions relative to the frame at all times; and at least one counter-weight that is alternatively supported by the frame and the counter-weight support.

29. The exercise weight stack assembly of claim 28, wherein the counter-weight support occupies an uppermost position whenever the top plate occupies a lowermost position, and the at least one counter-weight is supported by the frame proximate the uppermost position of the counter-weight support.

30. The exercise weight stack assembly of claim 28, wherein the flexible connector extends through the at least one counterweight.

31. The exercise weight assembly of claim 28, wherein when the assembly is at rest, an uppermost portion of the counter-weight support and a lowermost portion of the at least one counter-weight face toward one another, and a gap is defined therebetween.

32. The exercise weight assembly of claim 28, wherein the at least one counter-weight includes a first counterweight and a second counter-weight disposed about the first counter-weight, and the first counter-weight must be loaded onto the counter-weight support before the second counter-weight may be loaded onto the counter-weight support.

33. The exercise weight assembly of claim 28, wherein the assembly consists essentially of the frame; the stack of weights; the counter-weight support; the flexible connector; and the at least one counter-weight.

* * * * *